US008695676B2

(12) United States Patent
Lin

(10) Patent No.: US 8,695,676 B2
(45) Date of Patent: Apr. 15, 2014

(54) WINDOW BLIND ASSEMBLY

(76) Inventor: Shih-Ming Lin, Chiayi Hsien (TW)

( * ) Notice: Subject to any disclaimer, the term of this patent is extended or adjusted under 35 U.S.C. 154(b) by 22 days.

(21) Appl. No.: 13/528,533

(22) Filed: Jun. 20, 2012

(65) Prior Publication Data

US 2013/0340950 A1 Dec. 26, 2013

(51) Int. Cl.
*A47H 5/00* (2006.01)

(52) U.S. Cl.
USPC ..... 160/84.01; 160/89; 160/108

(58) Field of Classification Search
USPC ..... 160/84.01, 84.02, 84.04, 170, 23.1, 160/314, 313, 309, 121.1
See application file for complete search history.

(56) References Cited

U.S. PATENT DOCUMENTS

| | | | | |
|---|---|---|---|---|
| 2010/0294438 | A1* | 11/2010 | Kirby et al. | 160/84.04 |
| 2011/0067820 | A1* | 3/2011 | Hsu et al. | 160/84.03 |
| 2011/0192550 | A1* | 8/2011 | Williams, III | 160/84.04 |
| 2011/0203742 | A1 | 8/2011 | Lin | |
| 2011/0253324 | A1* | 10/2011 | Lin | 160/309 |
| 2012/0103538 | A1* | 5/2012 | Gleinser | 160/84.04 |

FOREIGN PATENT DOCUMENTS

EP 2369119 A1 9/2011

OTHER PUBLICATIONS

European Search Report for EP 12174748, mailed Jan. 14, 2013, 1 page.

* cited by examiner

*Primary Examiner* — Blair M. Johnson
(74) *Attorney, Agent, or Firm* — Schwabe Wiliamson & Wyatt

(57) ABSTRACT

A window blind assembly includes a curtain having multiple partitioning portions, and a curtain control unit for bringing the curtain to fold upwardly and unfold downwardly. The curtain control unit includes a winding rod, a blind piece wound around and extended from the winding rod, and a plurality of connecting members each mounted on a respective one of the partitioning portions. Each connecting member and a corresponding partitioning portion define a slot therebetween. Each connecting member includes a connecting strip, a support rod mounted at the connecting strip to stiffen the connecting strip, and a fastener for removably fastening the connecting strip to the corresponding partitioning portion.

5 Claims, 4 Drawing Sheets

WINDOW BLIND ASSEMBLY

BACKGROUND OF THE INVENTION

1. Field of the Invention

The present invention relates to a window blind assembly, more particularly to a window blind assembly that is used for covering a window and that includes a curtain control unit for bringing a curtain to fold upwardly and unfold downwardly.

2. Description of the Related Art

A conventional window blind assembly is disclosed in U.S. Patent Application Publication No. 2011/0203742. In FIG. 3 and FIG. 13 of the aforementioned publication, the window blind assembly includes a horizontal frame, a curtain member which has a top edge mounted at the horizontal frame and which includes a plurality of horizontally extending partitioning portions vertically spaced apart from each other, and a roller blind unit for bringing the curtain member to fold upwardly and unfold downwardly. The roller blind unit includes a horizontally extending roller rod mounted rotatably at the horizontal frame, a driving member operable to drive the roller rod to rotate about an axis of the roller rod, two roller blind pieces wound around and extended from the roller rod, two weighting rods each mounted to a bottom portion of the respective roller blind piece, and a plurality of connecting members each mounted on a respective one of the partitioning portions. Each of the connecting members and a corresponding one of the partitioning portions defines a slot therebetween for extension of the corresponding roller blind piece therethrough.

Each of the connecting members in the conventional window blind assembly has a confining portion in the form of a cloth strip, and two securing portions that connect the confining portion to a respective one of the partitioning portions. The securing portions may be realized through hook fasteners or loop fasteners.

For the purpose of maintaining dimensional stability of the slot, the confining portion is preferably stretched longitudinally prior to being fastened to the respective partitioning portion of the curtain member by means of the securing portions. Since the confining portion in the form of a cloth strip is substantially flexible, when the stretched confining portion contracts to its original length, the partitioning portion of the curtain member is brought to contract as well, such that the curtain member experience wrinkling and the appearance of the window blind assembly is adversely influenced. However, if the confining portion is loosely fastened to the partitioning portion, dimensions of the slot may be unstable, such that not only is the appearance of the curtain member adversely influenced but smooth folding and unfolding of the curtain member may be affected as well.

SUMMARY OF THE INVENTION

Therefore, the object of the present invention is to provide a window blind assembly which may be folded and unfolded smoothly and which is substantially flat in appearance.

According to the present invention, a window blind assembly comprises a frame, a curtain which has a top edge mounted at the frame and which includes a plurality of horizontally extending partitioning portions vertically spaced apart from each other, and a curtain control unit for bringing the curtain to fold upwardly and unfold downwardly. The curtain control unit includes a horizontally extending winding rod mounted rotatably at the frame, a driving member operable to drive the winding rod to rotate about an axis of the winding rod, at least one blind piece wound around and extended from the winding rod, at least one weighting rod mounted to a bottom portion of the blind piece, and a plurality of connecting members each mounted on a respective one of the partitioning portions. Each of the connecting members and a corresponding one of the partitioning portions defines a slot therebetween for extension of the blind piece therethrough. Each of the connecting members includes a connecting strip, a support rod mounted at the connecting strip to stiffen the connecting strip, and a fastener for removably fastening the connecting strip to the corresponding one of the partitioning portions.

Effects of the present invention reside in that, by virtue of the support rod which stiffens the connecting strip, not only may flatness of the curtain be ensured, but dimensions of the slot may also be maintained stable so as to promote smooth folding and unfolding of the curtain.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
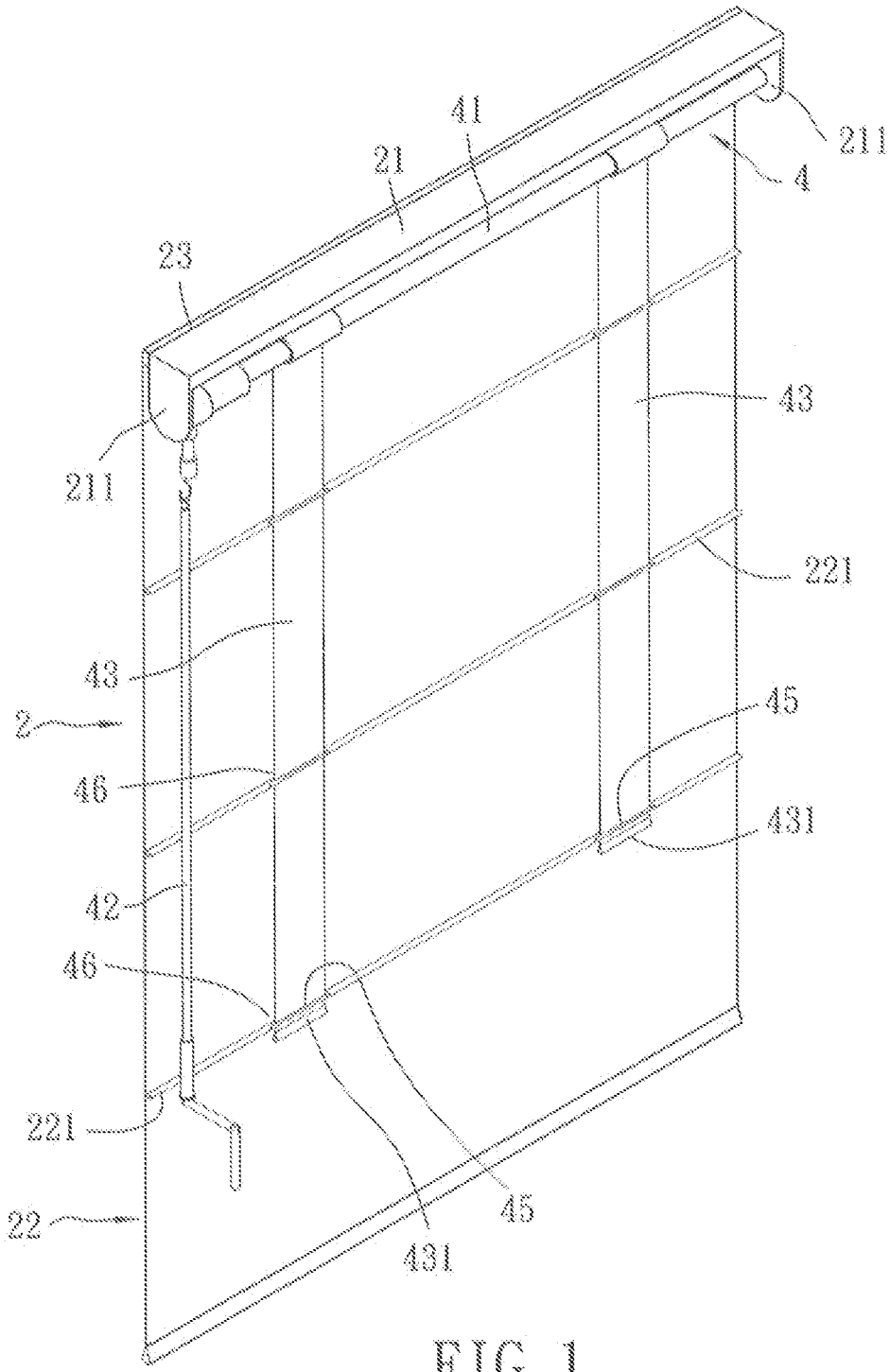
FIG. 1 is a perspective view of a preferred embodiment of a window blind assembly according to the present invention.
Figure 2:
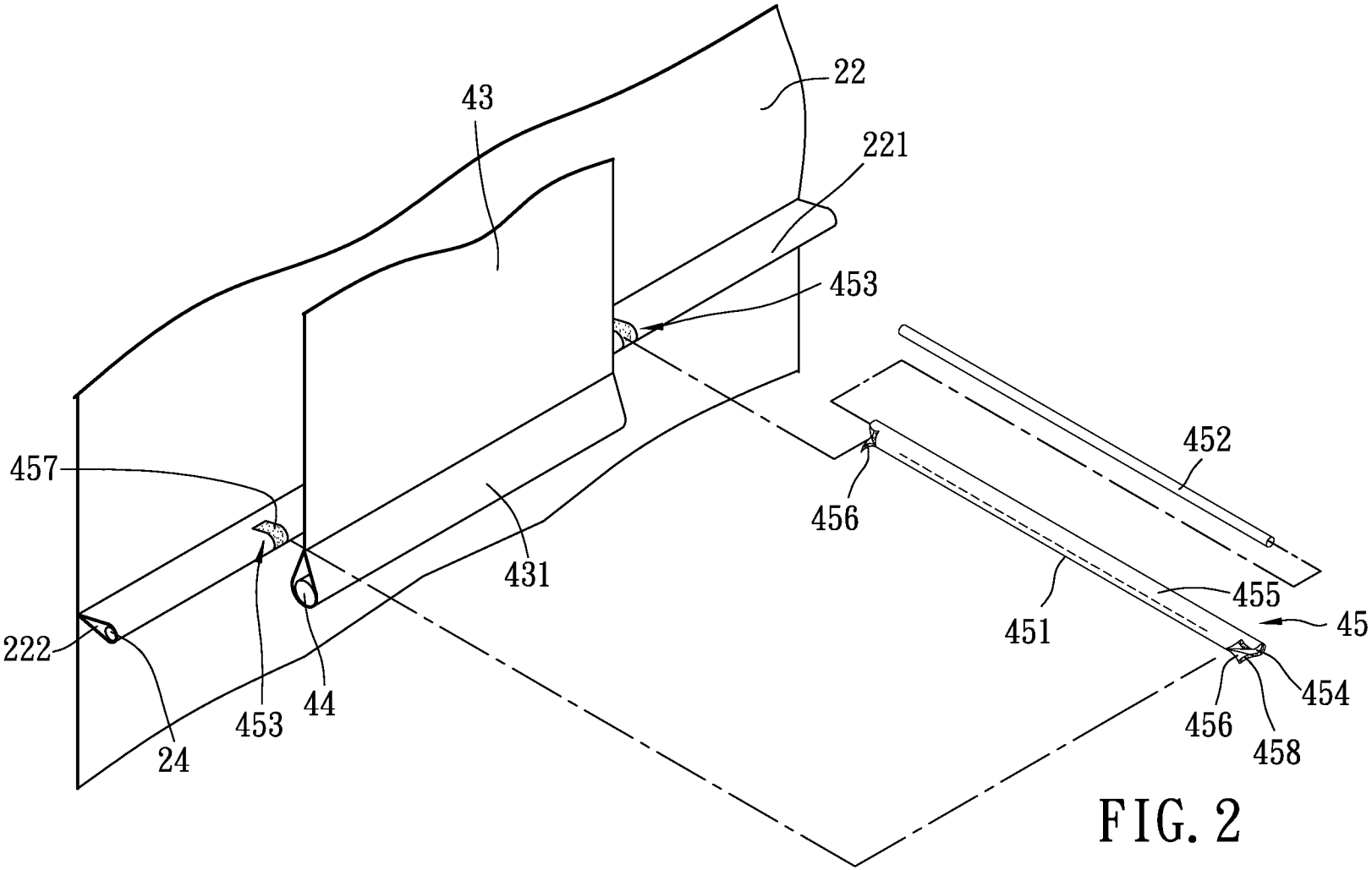
FIG. 2 is a fragmentary partly exploded perspective view of the preferred embodiment.
Figure 3:
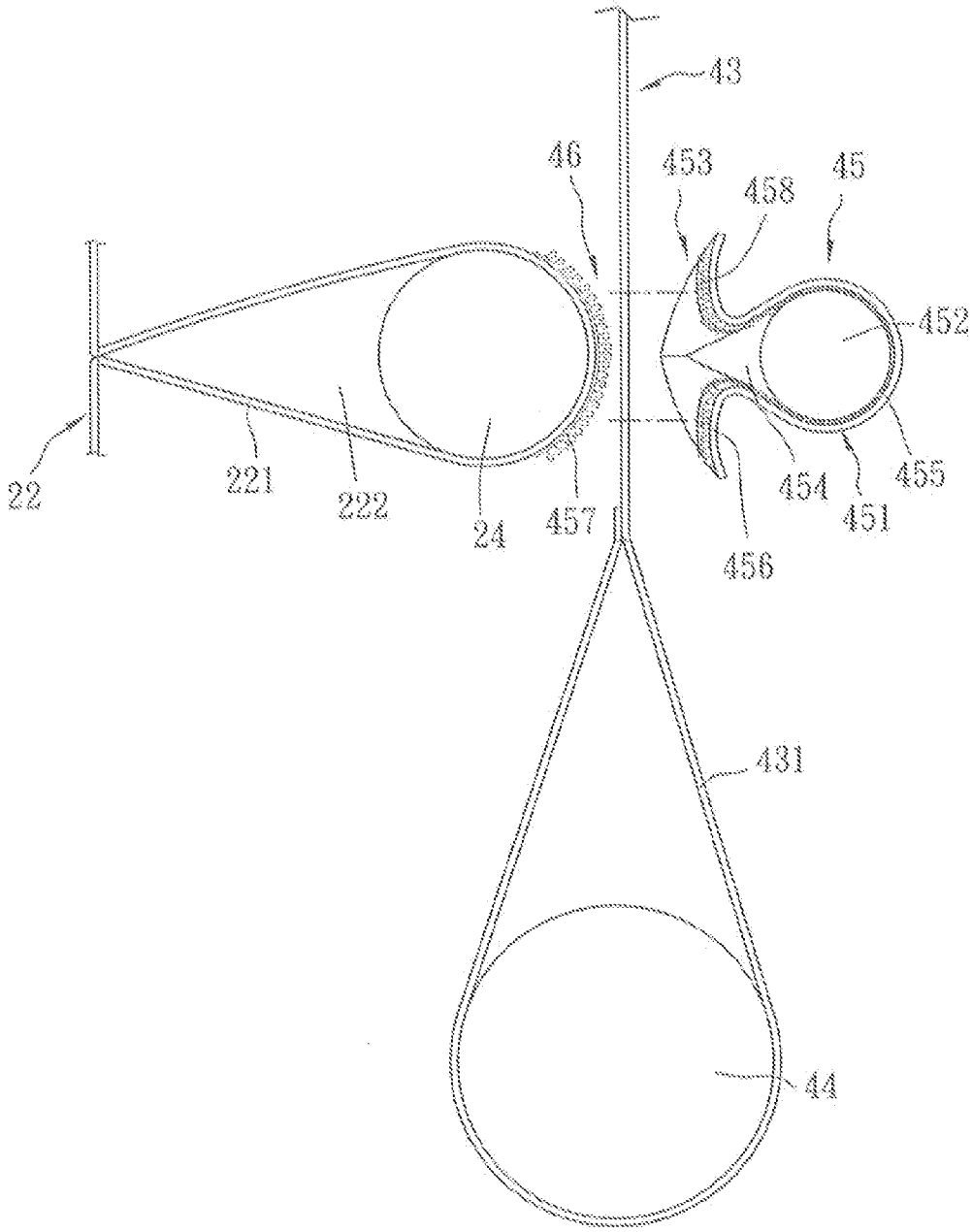
FIG. 3 is a fragmentary schematic view of the preferred embodiment, illustrating arrangements of a connecting member and a partitioning portion.

Referring to FIGS. 1, 2 and 3, a preferred embodiment of a window blind assembly 2 according to the present invention is adapted for being mounted proximate to a top edge of a window (not shown). The preferred embodiment of the window blind assembly 2 comprises a frame 21, a curtain 22 which has a top edge, a hook-and-loop fastener 23 (such as a Velcro® fastener) for mounting removably the top edge of the curtain 22 to the frame 21, a plurality of support bars 24 mounted to the curtain 22, and a curtain control unit 4 for bringing the curtain 22 to fold upwardly and unfold downwardly. The frame 21 includes two left and right mounting wings 211 spaced apart from each other. The curtain 22 includes a plurality of horizontally extending partitioning portions 221 vertically spaced apart from each other. Each of the support bars 24 is mounted to a respective one of the partitioning portions 221 of the curtain 22. Preferably, each of the partitioning portions 221 is tubular and defines a tube space 222, and each of the support bars 24 is inserted into the tube space 222 of the respective one of the partitioning portions 221.

In this embodiment, the curtain control unit 4 includes a horizontally extending winding rod 41 mounted rotatably between the two mounting wings 211 of the frame 21, a driving member 42 operable to drive the winding rod 41 to rotate in opposite directions about an axis of the winding rod 41, two blind pieces 43 wound around and extended from the winding rod 41, two weighting rod 44 each mounted to a bottom portion 431 of a respective one of the blind pieces 43, and a plurality of connecting members 45 each fastened removably to a respective one of the partitioning portions 221 of the curtain 22. Each of the connecting members 45 and a corresponding one of the partitioning portions 221 define a slot 46 therebetween for extension of a corresponding one the blind pieces 43 therethrough.

In this embodiment, each of the connecting members 45 includes a connecting strip 451, a support rod 452 mounted at the connecting strip 451 to stiffen the connecting strip 451, and a fastener 453 for removably fastening the connecting strip 451 to the corresponding one of the partitioning portions 221 of the curtain 22. The connecting strip 451 is a tubular cloth strip and confines a receiving space 454 for receiving the support rod 452. More particularly, the connecting strip 451 includes a surrounding wall 455 that defines the receiving space 454. The surrounding wall 455 includes two fastening parts 456 which are respectively proximate to opposite lateral ends of the receiving space 454 and which face the curtain 22 when the connecting members 45 are combined with the partitioning portions 221. The fastener 453 of each of the connecting members 45 includes two first fastener components 457 which are mounted on the corresponding one of the partitioning portions 221 of the curtain 22, and two second fastener components 458 which are mounted respectively on the fastening parts 456 and which correspond in position to the first fastener components 457. The first fastener components 457 are respectively proximate to opposite lateral sides of the slot 46. The second fastener components 458 are removably fastened to the first fastener components 457. In this embodiment, one of the first and second fastener components 457 and 458 is a hook fastener and the other one of the first and second fastener components 457 and 458 is a loop fastener.

Figure 4:
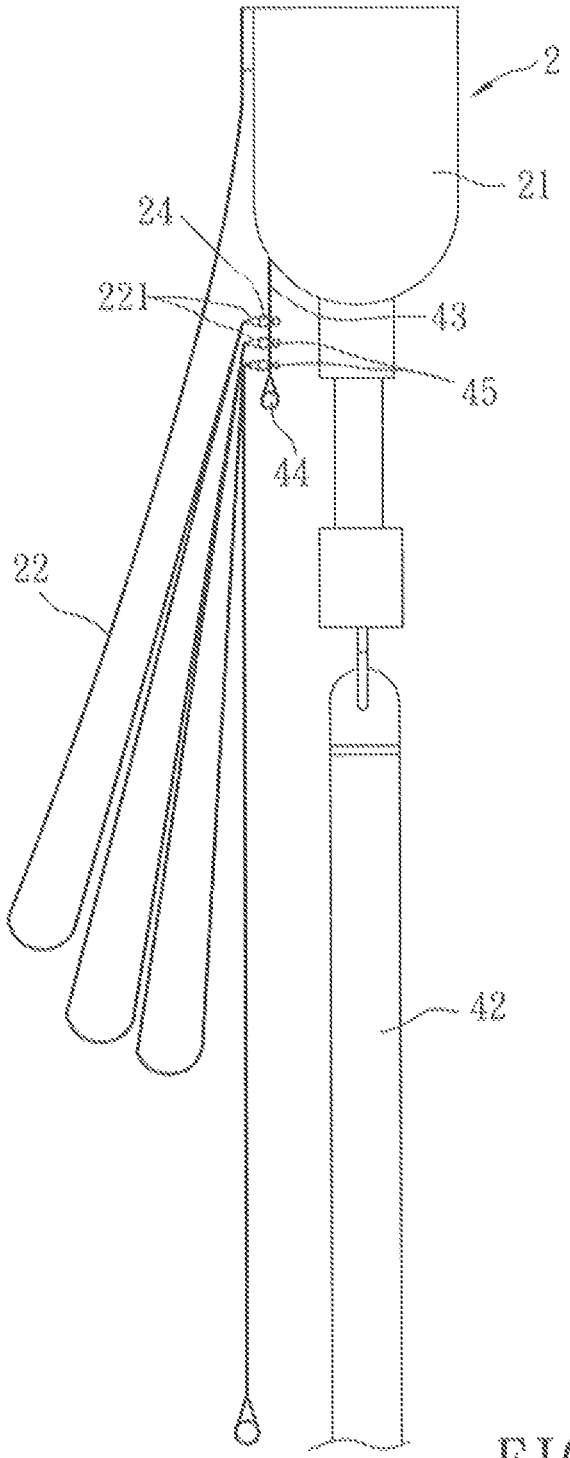
FIG. 4 is a fragmentary schematic side view of the preferred embodiment, illustrating folding of a curtain of the window blind assembly.

Referring to FIGS. 1, 3 and 4, after assembling the window blind assembly 2, the bottom portion 431 of a respective one of the blind pieces 43 is located under a lowermost one of the partitioning portions 221 and a lowermost one of the connecting members 45. When the window blind assembly 2 is desired to be converted from an unfolded state shown in FIG. 1 into a folded state shown in FIG. 4, the driving member 42 is manipulated to drive the winding rod 41 to rotate about the axis of the winding rod 41, such that the blind pieces 43 are wound around the winding rod 41 and are displaced upwardly. In the meantime, the weighting rods 44 are displaced upwardly so as to lift up the connecting members 45 and the partitioning portions 221. Owing to the support rod 452 received in the connecting strip 451 of each of the connecting members 45 and owing to the support bar 24 inserted into each of the partitioning portions 221 of the curtain 22, during a process where the window blind assembly 2 is folded, the connecting strip 451 of each of the connecting members 45 and the partitioning portions 221 may be kept stiff, and dimensional stability of the slots 46 defined therebetween may be ensured so as to promote smooth folding of the window blind assembly 2.

On the other hand, when the driving member 42 is manipulated reversely, the blind pieces 43 are extended from the winding rod 41 so as to bring the curtain 22 to unfold downwardly. Since techniques related to how to utilize the driving member 42 for bringing the blind pieces 43 to be wound around and extended from the winding rod 41 have been disclosed in the aforementioned U.S. Patent Application Publication No. 2011/0203742, details of the same are omitted herein for the sake of brevity.

To sum up, in this invention, each of the connecting strips 451 is a tubular structure which defines the receiving space 454, and the support rod 452 is received in the receiving space 454 for stiffening the connecting strip 451 of the connecting member 45. By virtue of the connecting members 45 in cooperation with the partitioning portions 221 of the curtain 22 which are mounted with the support bars 24, the slots 46 defined therebetween may have better dimensional stability. Meanwhile, the connecting strips 451 may be kept flat and may not cause the curtain 22 to wrinkle. Therefore, the window blind assembly of the present invention may have a substantially flat appearance and may be folded upwardly and unfolded downwardly in a smooth manner.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A window blind assembly comprising:

a frame;

a curtain which has a top edge mounted at said frame and which includes a plurality of horizontally extending partitioning portions vertically spaced apart from each other; and a curtain control unit for bringing said curtain to fold upwardly and unfold downwardly, said curtain control unit including a horizontally extending winding rod mounted rotatably at said frame, a driving member operable to drive said winding rod to rotate about an axis of said winding rod, at least one blind piece wound around and extended from said winding rod, at least one weighting rod mounted to a bottom portion of said blind piece, and a plurality of connecting members each mounted on a respective one of said partitioning portions, each of said connecting members and a corresponding one of said partitioning portions defining a slot therebetween for extension of said blind piece therethrough, each of said connecting members including a connecting strip, a support rod mounted at said connecting strip to stiffen said connecting strip, and a fastener for removably fastening said connecting strip to the corresponding one of said partitioning portions, wherein said connecting strip is tubular and confines a receiving space for receiving said support rod, said connecting strip including a surrounding wall that defines said receiving space, said surrounding wall including two fastening parts respectively proximate to opposite lateral ends of said receiving space, said fastener of each of said connecting members including two first fastener components which are mounted on the corresponding one of said partitioning portions and two second fastener components which are mounted respectively on said fastening parts and which correspond in position to said first fastener components, said second fastener components being removably fastened to said first fastener components.

2. The window blind assembly as claimed in claim 1, wherein one of said first and second fastener components is a hook fastener and the other one of said first and second fastener components is a loop fastener.

3. The window blind assembly as claimed in claim 2, wherein said first fastener components are respectively proximate to opposite lateral sides of said slot.

4. The window blind assembly as claimed in claim 3, further comprising a plurality of support bars each mounted to a respective one of said partitioning portions of said curtain.

5. The window blind assembly as claimed in claim 4, wherein each of said partitioning portions is tubular and each of said support bars is inserted into the respective one of said partitioning portions.

* * * * *